United States Patent [19]

Reed

[11] Patent Number: 4,656,568

[45] Date of Patent: Apr. 7, 1987

[54] LAMP SHADE

[76] Inventor: Martin R. Reed, 23405 Caminito Telmo, Laguna Hills, Calif. 92653

[21] Appl. No.: 813,606

[22] Filed: Dec. 26, 1985

[51] Int. Cl.[4] ..... F21Y 1/06

[52] U.S. Cl. ..... 362/352; 362/360; 362/358

[58] Field of Search ..... 362/352, 358, 360, 353

[56] References Cited

U.S. PATENT DOCUMENTS

| | | | |
|---|---|---|---|
| 3,764,801 | 10/1973 | Mainieks | 362/352 |
| 3,787,676 | 1/1974 | Korach | 362/352 |
| 4,165,529 | 8/1979 | Hagelthorn | 362/358 |
| 4,277,822 | 7/1981 | Weber et al. | 362/352 |
| 4,467,405 | 8/1984 | Weber | 362/352 |

*Primary Examiner*—E. Rollins Cross

*Attorney, Agent, or Firm*—Gordon L. Peterson

[57] ABSTRACT

A lamp shade comprising a plurality of panels having upper and lower edge portions and a panel support. A plurality of clips attach the panels to the panel support, with the panels being arranged in a circumferentially extending pattern. Each of the clips has a panel groove and a support groove for receiving edge portions of the panel and the panel support, respectively. Each of the panels includes a panel member and a border member extending at least part way around the panel member and having confronting ends. The panel groove of each of the clips receives an edge portion of an associated panel and the confronting ends of the border member. This at least assists in holding the confronting ends of the border member on the panel member.

11 Claims, 5 Drawing Figures

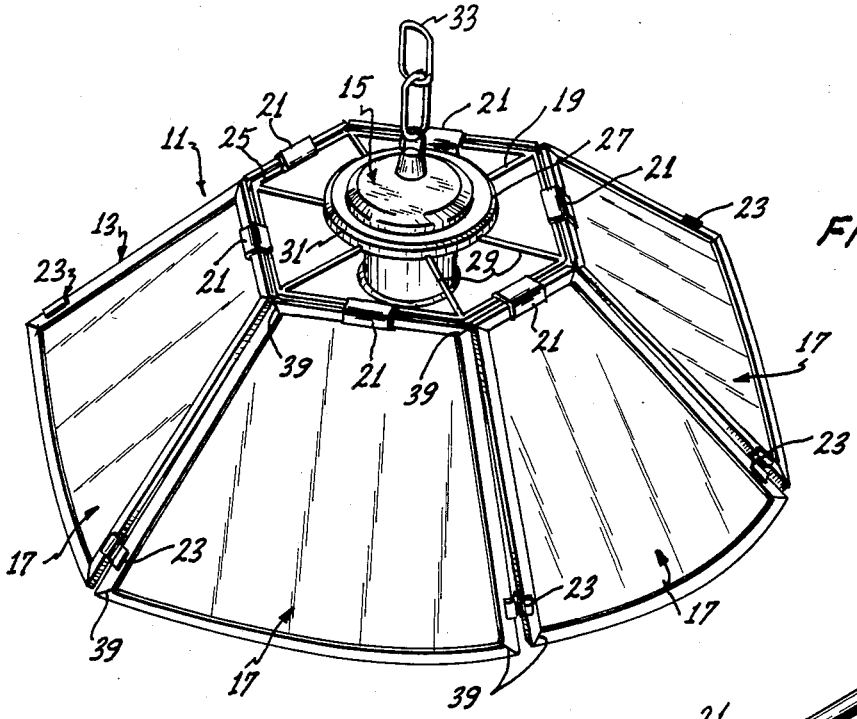
FIG. 1
FIG. 2
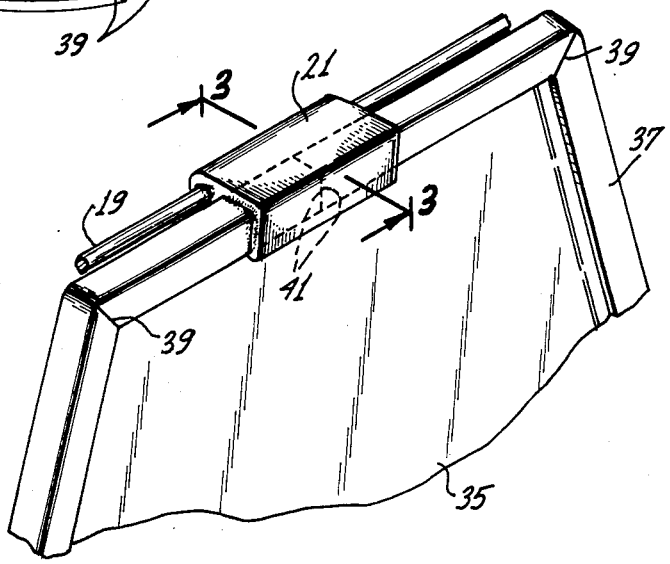
FIG. 3
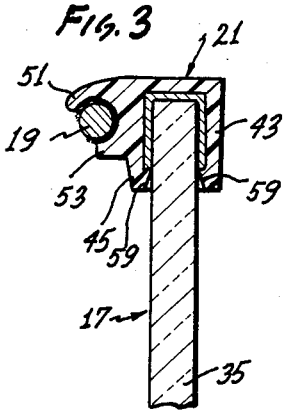
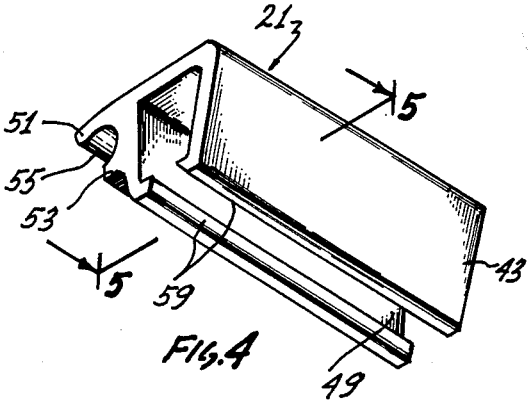
FIG. 4
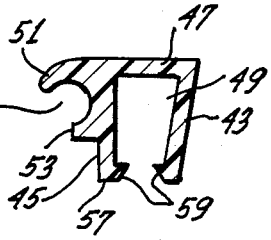
FIG. 5

LAMP SHADE

BACKGROUND OF THE INVENTION

This invention relates to a lamp shade of the type which includes one or more panel supports and a plurality of panels attached to the panel support in a circumferentially extending pattern. For example, the panel support may be in the form of a wire hanger lying along upper edges of the panels, and/or it may includes a wire frame extending along the lower edges of the panels and affixed thereto.

One problem with lamp shades of this type relates to the attachment of the panels to the panel supports. For example, some panel supports must be specially constructed in order to be attached to the panels, and examples of this are shown in Weber U.S. Pat. No. 4,467,405 and Weber et al U.S. Pat. No. 4,277,822. Another common means of attaching a hanger to the panels is to employ a tab on the hanger and a screw extending through the panel and into the tab. This is undesirable because it requires the drilling of holes in the panels, increases the likelihood of damage to the panels as a result of the drilling operation, and complicates assembly.

Each of the panels typically includes a panel member and a border member extending around the periphery of the panel member and attached thereto as by an adhesive. The border member has confronting ends which are typically brought together at one corner of the panel. One problem created by this construction is that the border member tends to separate from the panel member in the region of the confronting ends. Also, adhesive may extrude from between the border member and the panel member in this same region and require cleaning of the panel.

SUMMARY OF THE INVENTION

This invention overcomes these problems. With this invention, a simple, inexpensive clip is used to attach the panels to the panel supports. As a result, the panel supports can be of a conventional wire-like construction, if desired, and no special attachment features need to be incorporated into the panel supports. In addition, the clip simply slips over and grips regions of the panel and panel support. Consequently, drilling of the panel and potential consequent damage therefrom are eliminated, and assembly time is materially reduced.

With this invention, the clip not only attaches the panel to the panel support, but is also used to at least assist in retaining the end portions of the border member on the panel member. To accomplish this, the clip is slipped over the region of the panel having the confronting ends of the border member. Thus, the clip assists in retaining the ends of the border member against separation from the panel member. In addition, if adhesive is used to attach the border member to the panel member, the clip tends to conceal any adhesive which might extrude from between the ends of the border member.

The attachment of the panel support to the panels can be accomplished solely with the clips or with the clips in combination with other structure. Preferably, each of the clips has a first pair of legs for defining a panel groove and a second pair of legs for defining a support groove. The panel groove receives regions of one of the edge portions of one of the panels, with the legs of the panel groove resiliently gripping at least some of such region. The support groove receives a region of the panel support, with the legs of the support groove resiliently gripping at least some of such region of the panel support. Thus, the clip can be snap fit onto an edge portion of the panel member and the panel support.

Although the grooves can open in different directions, in a preferred construction, the panel groove opens in a first direction and the support groove opens in a second direction which is generally transverse to the first direction. In this preferred construction, the legs of the support groove project from one leg of the panel groove. One leg of the panel groove has a distal end, and one of the legs of the support groove is farther from the distal end and longer than the other leg of the support groove. With this construction, this longer leg can better serve to support the panel members on the panel support. In addition, the legs of the panel groove grip the border member of the panel and preferably have teeth which project toward each other from adjacent the distal ends of such legs. The teeth add strength and rigidity to the legs and can engage along the edges of the border member.

The clip can advantageously be extruded from a suitable plastic material, such as butyrate or ABS. If desired, the strength of the attachment between the clip and the panel can be enhanced with an adhesive.

The panel support can take the form of, for example, a conventional, inexpensive wire-like member which may be located, for example, along the upper or lower edges of the panels. In a common construction, the panel support takes the form of a wire hanger which extends along the upper edges of the panels. In any event, when the panels are attached to a panel support along the upper edges of the panel, it is necessary to provide means for holding the panel in a circumferentially extending pattern about such panel support. Such means is known and may take the form of separate clips engaging and gripping the side edges of the panels, a second or lower panel support extending along the lower edges of the panels or other suitable structure.

The invention, together with additional features and advantages thereof, may best be understood by reference to the following description taken in connection with the accompanying illustrative drawing.

BRIEF DESCRIPTION OF THE DRAWING

FIG. 1 is a perspective view of a lighting fixture constructed in accordance with the teachings of this invention.

FIG. 2 is a fragmentary, perspective view showing a clip and portions of one panel and a panel support.

FIG. 3 is a fragmentary, sectional view taken generally along line 3—3 of FIG. 2.

FIG. 4 is a perspective view of one of the clips.

FIG. 5 is a sectional view taken generally along line 5—5 of FIG. 4.

DESCRIPTION OF THE PREFERRED EMBODIMENT

FIG. 1 shows a lighting fixture 11 which includes a lamp shade 13 and mounting structure 15 for a light bulb (not shown). The lighting fixture 11 includes a plurality of panels 17, a panel support 19 and means for attaching the panels to the panel support, including clips 21. The panels 17 are arranged in a circumferentially extending pattern about the panel support and are held in such pattern by spring clips or retainers 23.

Although the panel support 19 can take different forms, in the illustrated embodiment, it includes an outer circumscribing wire 25, an inner wire 27 and radial spokes 29 interconnecting the wires 25 and 27. The inner wire 27 interlocks with a flange 31 of the mounting structure 15 so that the lamp shade 13 can be supported by the mounting structure 15 and suspended by a chain 33 in a conventional manner.

The panels 17 are identical, and each of them includes a broad, flat panel member 35 and a border member 37 which surrounds the panel member 35. Although the panel member 35 can take different forms, in this embodiment, it is in the form of a generally trapezoidal sheet of decorative glass. The border member 37 can also be of various different styles and configurations. However, in this embodiment, the border member 37 is in the form of an elongated channel (FIGS. 2 and 3) which receives an edge portion of the panel member 35.

More specifically, the border member 37 is a single, integral channel having partial slits 39 at each of the four corners of the associated panel member 35 and confronting ends 41 which are located in a central region of the upper edge portion of the panel member 35. For example, the border members 37 can be identical and constructed of a plastic material.

The clips 21 are preferably identical and extruded from a suitable plastic, such as butyrate or ABS. The clip 21 has a first pair of legs 43 and 45 which cooperate with a web 47 to define a panel groove 49 and a second pair of legs 51 and 53 which cooperate to define a support groove 55. The panel groove 49 opens in a first direction and the support groove 55 opens in a second direction which is generally transverse to the first direction. The legs 51 and 53 are integral with, and project from, the leg 45, with the leg 51 being longer than the leg 53. As shown in FIG. 5, the leg 53 is intermediate the leg 51 and a distal end 57 of the leg 45. The legs 43 and 45 have teeth 59 projecting toward each other closely adjacent their distal ends.

To assemble the lamp shade 13, the border member 37 is preferably adhered to the associated panel member 35 with an appropriate adhesive applied adjacent the confronting ends 41. The clips 21 are snap fit over regions of the upper edge portion of the associated panel 17 and a region of the outer wire 25 of the panel support 19. If desired, adhesive may also be employed to adhere the clip 21 to the associated panel 17.

As shown in FIGS. 2 and 3, the teeth 59 engage below the edges of the border member 37 and strongly interlock therewith. The legs 43 and 45, in their unstressed condition, project toward each other as they extend toward their distal ends (FIG. 5) and are straightened by the panel 17 as shown in FIG. 3 so that the legs 43 and 45 and the teeth 59 tightly grip a region of the upper edge portion of the panel. Accordingly, the clip 21 is strongly attached to its associated panel 17.

As shown in FIG. 2, the panel groove 49 receives the confronting ends 41 of the border member 37. By so doing, the clip 21 tightly holds the confronting ends 41 against the panel member 35 to strongly resist separation of the members 35 and 37. Also, any adhesive which might extrude between the confronting ends 41 tends to be somewhat concealed by the clip 21.

The clip 21 is also snap fit onto the panel support 19. The added length of the leg 51 provides additional support for the panel support 19.

In the illustrated embodiment, one clip 21 is provided for each of the panels 17. Of course, additional clips can be provided, if desired.

The retainers 23 are conventional, extruded plastic clips which are used to attach the confronting side edges of adjacent panels 17. Of course, other means, such as a lower wire-like support, can be used for holding the panel 17 in the circumferentially extending pattern.

Although an exemplary embodiment of the invention has been shown and described, many changes, modifications and substitutions may be made by one having ordinary skill in the art without necessarily departing from the spirit and scope of this invention.

I claim:

1. A lamp shade comprising:

a plurality of panels, each of said panels having upper and lower edge portions;

a panel support;

means for attaching said panels to said panel support in a circumferentially extending pattern about the panel support;

means for holding the panels in said circumferentially extending pattern;

said attaching means including a clip having a first pair of legs for defining a panel groove and a second pair of legs for defining a support groove, said panel groove receiving regions of one of the edge portions of one of the panels with the legs of the panel groove resiliently gripping at least some of said region of said one edge portion of said one panel and said support groove receiving a region of the panel support with the legs of the support groove resiliently gripping at least some of said region of the panel support.

2. A lamp shade as defined in claim 1 wherein said one panel includes a panel member and an elongated border member having confronting ends at said region of said one edge portion of said one panel and said panel groove at least partially receives said confronting ends.

3. A lamp shade as defined in claim 1 wherein said panel groove opens in a first direction and said support groove opens in a second direction which is generally transverse to said first direction.

4. A lamp shade as defined in claim 1 wherein said panel support includes a wire hanger adjacent the upper edge portions of the panels and said holding means includes clips joining adjacent panels adjacent the lower edges of said panels.

5. A lamp shade as defined in claim 1 wherein the legs of the second pair of legs project from one leg of the first pair of legs.

6. A lamp shade as defined in claim 5 wherein said first pair of legs have distal ends and teeth projecting toward each other from adjacent said distal ends.

7. A lamp shade as defined in claim 5 wherein said one leg of the first pair of legs has a distal end and one of the legs of the second pair of legs is farther from said distal end and longer than the other leg of said second pair of legs.

8. A lamp shade comprising:

a plurality of panels, each of said panels having upper and lower edge portions;

a panel support;

means for attaching said panels to said panel support in a circumferentially extending pattern about the panel support;

means for holding the panels in said circumferentially extending pattern;

at least one of said panels includes a panel member and an elongated border member extending at least part way around the panel member and having confronting ends along one of said edge portions of said one panel; and said attachment means including a clip for attaching said one edge portion to said support member, said clip having a groove for receiving a region of said one edge portion of said one panel and said confronting ends whereby the clip at least assists in holding the confronting ends of the border member on the panel member.

9. A lamp shade as defined in claim 8 wherein said border member includes a channel which extends around the periphery of the panel member and said shade includes adhesive to hold the channel at said confronting ends to the panel member and to hold the clip on the panel.

10. A lamp shade as defined in claim 8 wherein said clip includes means for snap fitting the clip onto said one edge portion of the panel member and onto the panel support.

11. A lamp shade as defined in claim 9 wherein said panel support includes a wire hanger adjacent the upper edge portions of the panels and said holding means includes clips joining adjacent panels adjacent the lower edges of said panels and said clip includes means for snap fitting the clip onto said one edge portion of the panel and onto the panel support.

* * * * *